US011084042B2

(12) United States Patent
Burhorst et al.

(10) Patent No.: US 11,084,042 B2
(45) Date of Patent: Aug. 10, 2021

(54) DUAL-SHAFT SHREDDER WITH INTERCHANGEABLE CUTTING BLADE SET AND RELEASABLE SHAFT ENDS

(71) Applicant: HUGO VOGELSANG MASCHINENBAU GMBH, Essen (DE)

(72) Inventors: Torsten Burhorst, Garel (DE); Paul Krampe, Essen (DE); Hugo Vogelsang, Löningen/Bunnen (DE)

(73) Assignee: VOGELSANG GMBH & CO. KG, Essen (DE)

( * ) Notice: Subject to any disclaimer, the term of this patent is extended or adjusted under 35 U.S.C. 154(b) by 160 days.

(21) Appl. No.: 16/349,343

(22) PCT Filed: Nov. 14, 2017

(86) PCT No.: PCT/EP2017/079213
§ 371 (c)(1),
(2) Date: May 13, 2019

(87) PCT Pub. No.: WO2018/087398
PCT Pub. Date: May 17, 2018

(65) Prior Publication Data

US 2019/0366352 A1 Dec. 5, 2019

(30) Foreign Application Priority Data

Nov. 14, 2016 (DE) ..... 202016106367.1

(51) Int. Cl.
*B02C 25/00* (2006.01)
*B02C 18/14* (2006.01)
(Continued)

(52) U.S. Cl.
CPC ..... *B02C 18/142* (2013.01); *B02C 18/0092* (2013.01); *B02C 18/182* (2013.01); *B02C 25/00* (2013.01)

(58) Field of Classification Search
CPC ..... B02C 18/10; B02C 18/142; B02C 18/143; B02C 18/146; B02C 18/166
See application file for complete search history.

(56) References Cited

U.S. PATENT DOCUMENTS 5,163,629 A 11/1992 Raterman et al.
5,275,342 A 1/1994 Galanty
(Continued)

FOREIGN PATENT DOCUMENTS

CA 1026460 2/1978
CN 101544266 9/2009
(Continued)

*Primary Examiner* — Shelley M Self
*Assistant Examiner* — Kevin E O'Brien
(74) *Attorney, Agent, or Firm* — Price Heneveld LLP

(57) ABSTRACT

A dual-shaft shredder for comminuting solids or solids in liquids comprises a housing defining an interior comminuting space, an inlet opening, an outlet opening, and a first and second cutting disc block each having a plurality of cutting discs disposed on a hub body such that an intermediate space is present between each two adjacent cutting discs. Some of the first cutting discs each engage in the intermediate space between two adjacent second cutting discs and some of the second cutting discs each engage in the intermediate space between two adjacent first cutting discs. A first shaft stub and a second shaft stub extend into an axial recess of the first and second cutting disc blocks for transmitting torques, and a first clamping device and a second clamping device clamp the shaft stubs against the cutting disc blocks.

19 Claims, 7 Drawing Sheets

(51) Int. Cl.
*B02C 18/00* (2006.01)
*B02C 18/18* (2006.01)

(56) References Cited

U.S. PATENT DOCUMENTS

| | | | | |
|---|---|---|---|---|
| 2011/0215180 | A1* | 9/2011 | Helm | B02C 15/005 241/107 |
| 2013/0214075 | A1* | 8/2013 | Abeln | B02C 18/18 241/236 |
| 2015/0202788 | A1* | 7/2015 | Harmon | B02C 18/148 83/481 |

FOREIGN PATENT DOCUMENTS

| | | | |
|---|---|---|---|
| CN | 101680525 | | 3/2010 |
| CN | 101716542 | | 6/2010 |
| CN | 102363126 | | 2/2012 |
| CN | 102537088 | | 7/2012 |
| CN | 103153470 | | 6/2013 |
| CN | 203091024 | | 7/2013 |
| CN | 103827521 | | 5/2014 |
| CN | 104040083 | | 9/2014 |
| CN | 104722551 | | 4/2015 |
| CN | 105195267 | | 12/2015 |
| DE | 3227862 | | 2/1983 |
| DE | 58908443 | | 5/1990 |
| DE | 19544639 | | 6/1997 |
| DE | 29803876 | | 5/1998 |
| DE | 202010010662 | | 11/2011 |
| EP | 0359942 | | 9/1994 |
| GB | 1459064 | | 12/1976 |
| JP | 2005224745 | | 8/2005 |
| JP | 2005334743 | | 12/2005 |
| JP | 2013532579 | | 8/2013 |
| KR | 20160100865 | A * | 8/2016 |

* cited by examiner

DUAL-SHAFT SHREDDER WITH INTERCHANGEABLE CUTTING BLADE SET AND RELEASABLE SHAFT ENDS

CROSS-REFERENCE TO FOREIGN PRIORITY APPLICATION

The present application claims the benefit under 35 U.S.C. §§ 119(b), 119(e), 120, and/or 365(c) of PCT/EP2017/079213 filed Nov. 14, 2017, which claims priority to German Application No. 202016106367.1 filed Nov. 14, 2016.

FIELD OF THE INVENTION

The invention relates to a dual-shaft shredder for comminuting solids or solids in liquids, comprising: a housing defining an interior comminuting space, an inlet opening in the housing for feeding solids into the comminuting space, an outlet opening in the housing for discharging comminuted solids out of the comminuting space, a first cutting disc block having a plurality of first cutting discs disposed on a first hub body such that an intermediate space is present between each two adjacent first cutting discs, a second cutting disc block having a plurality of second cutting discs disposed on a second hub body such that an intermediate space is present between each two adjacent second cutting discs, the first and second cutting disc blocks being axially offset from each other, such that at least some of the first cutting discs each engage in the intermediate space between two adjacent second cutting discs and some of the second cutting discs each engage in the intermediate space between two adjacent first cutting discs, the first and second cutting disc blocks each comprising a first axial recess.

BACKGROUND OF THE INVENTION

Dual-shaft shredders of the present type are used for comminuting solids, for example, organic materials such as branches, twigs, plants, or other materials, such as plastic waste. The solids to be comminuted can thereby be fed into the dual-shaft shredder through the inlet opening in a dry state or in a liquid stream.

For the purpose of effective comminuting, dual-shaft shredders comprise two shafts, on each of which a plurality of cutting discs are disposed. Said cutting discs mutually engage with each other, which is made possible and achieved in that an axial offset is present between two adjacent cutting discs of a shaft and greater than the thickness of a cutting disc of the other shaft, and the spacing between the axes of the two shafts is less than the diameter of a cutting disc.

The two shafts of a dual-shaft shredder are typically driven in opposite directions and to this end are coupled to each other, for example, by means of a corresponding gearbox. A good comminuting result is obtained particularly when the two shafts rotate at different rotary speeds. In this manner, high shear forces and fracture forces are produced in the intermediate space between the two shafts by the cutting discs running in opposite directions, leading to effective comminuting of the solids. Different rotary speeds also cause different blade segments of adjacent cutting discs to engage with each other with each revolution, whereby the cutting discs are automatically cleaned of adhered comminuted material.

A disadvantage of dual-shaft shredders of the present type is that, due to the type of motion of the two shafts and the cutting disc disposed thereon, cutting discs facing each other can be damaged if a hard solid body enters the comminuting space and becomes pinched between two cutting discs or between one cutting disc and the opposing shaft. This can cause severe damage to cutting discs in the region of the cutting edges thereof, whereby the ongoing operation of the dual-shaft shredder is no longer possible or only occurs at low comminuting efficiency. Wear can also occur on the cutting discs, depending on the type and amount of the material to be comminuted.

Equipping dual-shaft shredders with a quick-change system for this reason is known, wherein the blades can be removed from the shafts in order to replace such damaged blades. It is thereby achieved that the functionality of the dual-shaft shredder can be restored with little maintenance effort.

A further disadvantage of known dual-shaft shredders is that a solid object getting between two cutting disc meshing with each other or getting between a cutting disc and the shaft opposite thereto can lead to a substantial torque spike at the two cutting discs or the one cutting disc. Said torque spike can result in the torsionally fixed support of a cutting disc on a shaft becoming loose. Such damage to the torsionally fixed mounting of a cutting disc on the shaft can make further operating of the dual-shaft shredder impossible, or possible only at limited efficiency and particularly involving the risk of further damage to other components of the dual-shaft shredder.

It is further known from DE 20 2010 010 662 U1 to implement a dual-shaft shredder, as indicated above, such that the first cutting discs are implemented as a first cutting disc block, in that the first cutting discs are formed integrally on the first hub body, the hub body comprising an axial bore for disposing about a segment of the first shaft and torsionally fixedly attached to a first shaft, preferably by means of a positive shaft-hub connection, and the second cutting discs being implemented as a second cutting disc block, in that the second cutting discs are disposed integrally on the second hub body, the hub body comprising an axial bore for disposing about a segment of the second drive shaft and torsionally fixedly attached to the second shaft, preferably by means of a positive shaft-hub connection.

It has been found that said embodiment functions well and particularly has a long service life. There is, however, still a need for improving said embodiment, for simplifying production, for simplifying assembling and replacing the cutting disc block, and for increasing service life.

At large sizes, said integral cutting disc blocks, also known as monolithic ripper rotors, are implemented having a plurality of parts, because the production of long, axial, precise receiving bores is difficult and assembling is very difficult for such long cutting disc blocks, because both cutting disc blocks must be slid onto the long parallel shafts at the same time. The space required for sliding on long, single-piece cutting disc blocks is also very great.

For longer lengths of dual-shaft shredders, wherein the ratio of cost to throughput is typically favorable, shaft sag is also a problem, particularly for dual-shaft shredders having a plurality of individual cutting discs, because the individual discs do not provide great flexural rigidity. Multipart monolithic rotors do increase rigidity in the region of the load-bearing length thereof, but no flexural tension can be transmitted in the intersecting areas. Torque transmission is also possible here exclusively by means of a force fit, but not by means of a positive connection.

Conventional types of dual-shaft shredders having individual cutting discs or cutting disc blocks slid onto shafts can then be produced in larger and therefore more economical lengths, due to the lack of rigidity, only if said shredders comprise additional supporting bearings in the comminuting chamber. Said additional supporting bearings, however, have the disadvantage of reducing the potential throughput, because said bearings occupy a certain length of the comminuting space. Said bearings also cause problems because materials to be comminuted can be supported thereon and then cannot be comminuted and then further reduce or even completely block the pass-through cross section. Said supporting bearings are further exposed to the product on both sides, so that reliable sealing is very difficult to implement, so that the bearings fail often and then must be replaced at great effort. The replacing of damaged or worn blades is also made more difficult. In addition, the supporting bearings further cause substantial additional costs in the production of the dual-shaft shredder.

SUMMARY OF THE INVENTION

The object is achieved according to the invention for a dual-shaft shredder of the type indicated above by a first shaft stub extending into the first axial recess of the first cutting disc block for transmitting torque, a second shaft stub extending into the first axial recess of the second cutting disc block for transmitting torque, a first clamping device for clamping the first shaft stub against the first cutting disc block, and a second clamping device for clamping the second shaft stub against the second cutting disc block.

The invention is based on the insight that for cutting disc blocks comprising a central hub body on which individual cutting discs are disposed, it is not necessary to pass the drive shaft entirely through the hub body of the corresponding cutting disc block. Rather, it is sufficient to provide shaft stubs extending into corresponding recesses on the cutting disc block, particularly the hub body of the cutting disc block, and transmitting corresponding torques to the corresponding cutting disc block. The axial length of a cutting disc block is thereby variable with respect to the shaft stub and is independent of the precise design of the shaft stub.

According to the invention, first and second clamping devices are provided by means of which the corresponding cutting disc blocks can be clamped against the shaft stubs. The shaft stubs do not extend entirely through the corresponding hub body of each cutting disc block, but rather have an axial length in a range from 5% to 30%, preferably in a range from 5% to 15%, particularly preferably about 10%. The fixation between the shaft stub and the cutting disc block, particularly the axial fixation, is implemented by means of the clamping device. Said device can be a radially expanding clamping body, for example, such as a double cone or the like, in the interior of the recess for providing clamping. Torque transfer is preferably implemented by means of a key or another typical shaft-hub connection.

The individual cutting discs are preferably integrally formed on the hub body, and the cutting disc block is particularly entirely cut from a solid material by means of machining, particularly turning and milling.

Assembly is thus simplified overall. It is merely necessary to connect the cutting disc blocks to the shaft stubs and to actuate the clamping devices, so that the cutting disc blocks are attached to the shaft stubs. For disassembly, the clamping devices are released correspondingly and the cutting disc blocks removed.

According to a first preferred embodiment, the first and second shaft stub each comprise a truncated cone-shaped segment contacting a corresponding truncated cone-shaped segment of the first axial recesses of the first and second cutting disc blocks. The truncated cone-shaped segment on the first and second shaft stubs is preferably provided at the axial end face thereof, that is, at the end facing away from a drive. The truncated cone-shaped segment is therefore provided at the end of the shaft stub received in the recess of the cutting disc blocks. The truncated cone-shaped segment is implemented such that the shaft stub tapers down toward to the axial end. At the same time, the first axial recesses comprise a corresponding truncated cone-shaped segment, such that the recesses also taper down slightly in the direction toward the center of the cutting disc blocks. By implementing such corresponding truncated cone-shaped segments, production tolerances can be compensated for. Both production and assembly are thereby substantially simplified. The corresponding truncated cone-shaped segments simultaneously produce a self-centering of the cutting disc bocks to the corresponding shaft stubs.

The truncated cone-shaped segment of the cutting disc blocks is preferably formed by a sleeve placed in the first axial recess. Production is thereby further substantially simplified. It is further possible to produce the sleeve from a different material than the cutting disc block itself.

The sleeve is preferably pretensioned by means of a spring packet. For example, to this end, a protrusion is provided at the base end of the recess on which a spring packet is supported. The spring packet preferably comprises a plurality of spring washers. In a preferred variant, a transmitting element is provided between the sleeve and the spring packet, for example, serving for centering the spring packet. Clearance is thereby further compensated for and the two truncated cone-shaped surface can contact each other without clearance. The corresponding cutting disc block is thus clamped against the corresponding shaft stub without clearance.

In a preferred refinement, it is provided that the dual-shaft shredder comprises a first and a second axle insert, the first and second cutting disc blocks each comprising a second axial recess and the first axle insert being received in the second axial recess of the first cutting disc block and the second axle insert being received in the second axial recess of the second cutting disc block. The second axial recesses are preferably provided at the opposite end face relative to the first axial recesses on the cutting disc block, particularly the hub body.

It is thereby preferable that the first and second axial recesses are each connected to each other by an axial bore and the clamping devices comprise means for clamping the first axle insert against the first shaft stub and for clamping the second axle insert against the second shaft stub. Assembly is thereby further substantially simplified. If the corresponding cutting disc blocks are placed on the corresponding shaft stubs, it is possible to clamp the same from the free end of the cutting disc blocks by means of the clamping devices. For example, a tension rod, tension cable, or other tensioning means is provided to this end and pulls the first or second axle insert against the first or second shaft stub. Known tensioning means, such as threaded connections or the like, can be provided for tensioning the tension rod, the tension cable, or the like.

The means for clamping preferably comprise a first and a second threaded rod. The first threaded rod is preferably received in a threaded bore in the first shaft stub and extends into or through a through hole in the first axle insert, and the second threaded rod is simultaneously received in a second threaded bore in the second shaft stub and extends through a through hole in the second axle insert. The through holes in the axle inserts can be implemented as threaded bores. Alternatively, the through holes can be provided without threads, and a nut provided on the outer side of the axle inserts relative to the cutting disc blocks, by means of which the first and second axle inserts can be pretensioned in the direction of the first and second shaft stubs. Particularly simple clamping of the cutting disc blocks on the shaft stubs is thereby achieved.

In a further preferred embodiment, the first and second axle inserts are implemented as axle stubs for supporting the first and second cutting disc blocks. It is thereby possible to also support the cutting disc blocks on the side opposite the shaft stubs in a simple manner. Such a double support is preferable, as high bearing forces can occur when cutting hard materials.

It is thereby further preferable that the first and second axle inserts each comprise a truncated cone-shaped segment contacting a corresponding truncated cone-shaped segment in second recesses of the first and second cutting disc blocks. The first and second axial recesses are particularly preferably implemented symmetrically to each other in the cutting disc blocks. Here, symmetrically means that both mirror and point symmetry are preferred, including mirror symmetry in that the first and second recesses are rotated relative to each other with respect to a central axis. More than symmetry, however, it is critical that said recesses are substantially identical in the internal geometry thereof. It is thereby possible to rotate the cutting disc blocks and, for example, to place the second axial recess of the first cutting disc block on the first shaft stub. Assembly is thereby further substantially simplified. Production is also simplified, because it is not necessary to provide two different recesses, but rather it is possible to form said recesses identically. Identical parts can further be used, and production is simplified.

A sleeve and a corresponding spring packet are further preferably provided in the second axial recess, so that the axle insert, preferably implemented as an axle stub, can be clamped against the corresponding cutting disc block without clearance.

In a further preferred embodiment, the first and second axle stubs are received in a bearing housing forming a unit together with the axle stubs and reversibly removable as a unit from the cutting disc blocks and/or from the housing in which the cutting disc blocks are disposed. The clamping devices are preferably accessible from outside of the bearing housing or on the same. In this manner, the bearing housing can be placed on the two cutting disc blocks as a structural unit, module, or assembly unit, such that the axle stubs engage in the second axial recesses. The clamping devices are then actuated from outside the bearing housing, so that the axle stubs are clamped against the shaft stubs and the cutting disc blocks are thus fixed. Due to the conicity of the shaft stubs and the axle stubs, self-centering thereby occurs and clamping of the cutting disc blocks without clearance occurs simultaneously. Assembly is thereby very simple.

In a further preferred embodiment, the dual-shaft shredder comprises an oil supply device for supplying a bearing of the first and/or second cutting disc block with oil through an oil channel, particularly through an oil channel extending through the first cutting disc block. The bearing can comprise both rolling bearings and plain bearings. The oil supply device is preferably set up for checking a leak-tightness of the oil supply and in this manner detecting a leakage in the seal. The oil supply device is preferably accessible from the outside in the installed condition of the dual-shaft shredder.

The oil supply device can be refined in that the oil channel comprises a first oil channel segment running through the first axial bore of the first cutting disc block. The oil supply device preferably comprises a second oil channel segment fluidically connected to the first oil channel segment and providing oil for a bearing of the second cutting disc block. Said oil routing allows a protected oil channel location not susceptible to external effects. Said oil channel routing further makes it possible to remove the first and second cutting disc blocks together with the end bearings thereof, without external oil lines first needing to be removed or without having to implement complex pass-through lines of external oil lines to the bearings. This facilitates maintenance of the dual-shaft shredder and is particularly significant if the dual-shaft shredder is installed in an arrangement difficult to access, such as in a drain. The oil routing according to the invention can prevent the entire dual-shaft shredder from first needing to be removed from the drain in order to replace the cutting disc blocks, but rather the cutting disc blocks can be removed from the housing of the dual-shaft shredder installed in the drain without the risk of oil escaping.

The first oil channel segment particularly preferably runs through the first shaft stub and/or the first axle insert. It is thereby particularly preferred if the first oil channel segment runs through both the first shaft stub and through the first axle insert. The second oil channel segment can also run through the second shaft stub and the second axle insert and/or can be implemented as a connection between the lubricating space of the bearing of the first cutting disc block and the bearing of the second cutting disc block. In this manner, no additional openings or connections to the bearings of the cutting disc blocks are required. Replacing the cutting disc blocks is thereby also simplified.

It is further preferable if the dual-shaft shredder is refined by an oil monitoring device implemented for detecting a leakage of a seal sealing the bearing, wherein the oil monitoring device is implemented for performing the detecting by monitoring the oil level or the oil pressure in the oil channel.

Such an oil monitoring device serves for detecting insufficient lubrication of the bearing in a timely manner in order to prevent damage to the bearing. Insufficient lubrication typically occurs as a result of a leakage of a seal sealing the bearing. Such a leakage can have the effect, for example, that liquid is forced into the oil circuit from the interior space of the dual-shaft shredder, causing an increase in the oil level or the oil pressure. A leakage, however, typically causes a loss of oil from the oil circuit, whereby the oil level and the oil pressure drop. It is thereby understood that leak-tightness can be tested by a user by manually monitoring a corresponding indicator. The leak-tightness can also be tested in a fully or partially automated manner, in that an oil level or oil pressure is monitored by means of a sensor, for example, and if the monitored values fall below particular threshold values, a signal is output signaling insufficient lubrication. Said signal can be output to a user at a corresponding user interface, such as an acoustic warning signal, or can engage directly in the controller of the dual-shaft shredder and initiate a stop, for example.

BRIEF DESCRIPTION OF THE DRAWINGS

The invention is described in more detail below, using an embodiment example and referencing the attached figures. Shown are.

DETAILED DESCRIPTION OF THE EMBODIMENTS

Figure 1:
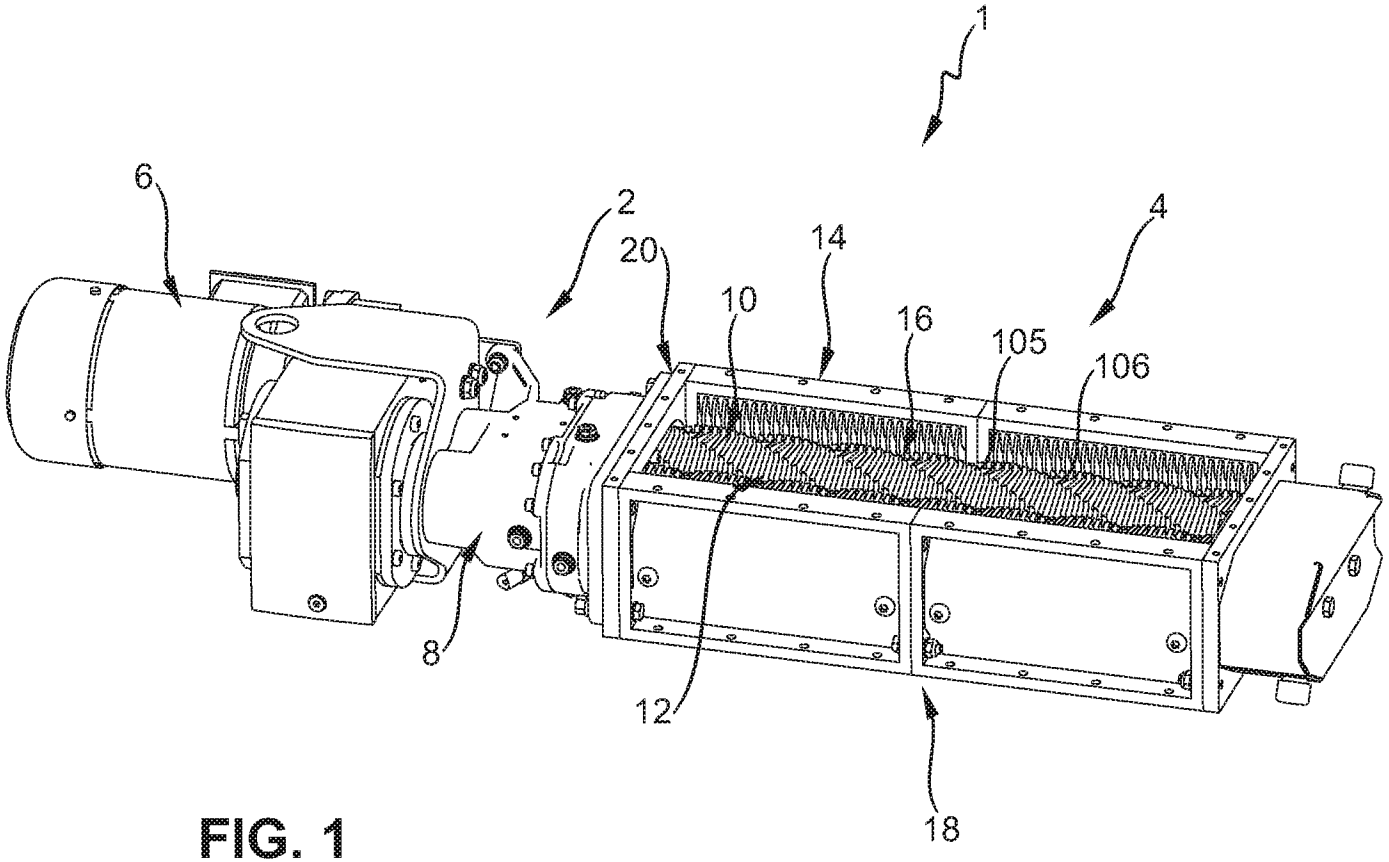
FIG. 1 is a perspective view of a dual-shaft shredder in an assembled state.

A dual-shaft shredder 1 according to the present embodiment example comprises a gearbox segment 2 and a comminuting segment 4. A drive motor 6 and a gearbox 8 are provided in the gearbox segment 2, by means of which the two first and second cutting disc blocks 10, 12 are coupled to the drive motor 6. The gearbox 8 comprises two gears having different numbers of teeth (not shown) meshing with each other. Rotary motions of the two cutting disc blocks 10, 12 are thereby produced in opposite directions and at different rotary speeds. Only the corresponding drive shaft (also not shown) of the first cutting disc block 10 is coupled to the drive motor 6, and the second drive shaft (not shown) for the second cutting disc block 12 is driven exclusively by the gearbox 8. The drive motor 6 and the gearbox 8 are altogether implemented as described in DE 20 2010 010 662 U1. In this respect, reference is made in full to said disclosure and the disclosed content thereof is incorporated herein.

The two cutting disc blocks 10, 12 are disposed in a housing 14 of the comminuting segment 4. The housing 14 comprises an inlet opening 16 and an outlet opening 18 each for connecting to a pipeline system or the like of a plant. The inlet opening 16 and the outlet opening 18 are implemented opposite each other and identical in geometry. It should be understood, however, that the inlet and outlet can be different, for example, in what are known as side rails. The housing 14 is coupled to the gearbox 8 by means of a flange 20. The housing 14 can also be removed from the gearbox 8 by means of the flange 20.

Figure 2:
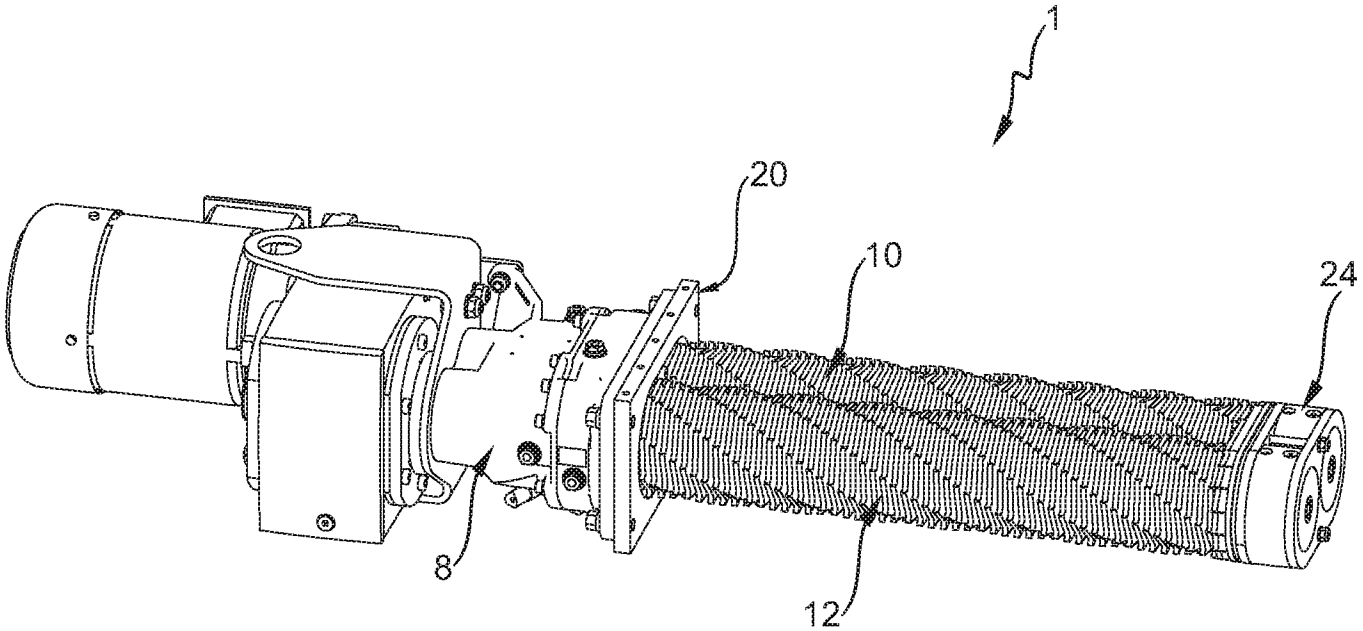
FIG. 2 is another view of the dual-shaft shredder from FIG. 1, wherein the housing is removed.

The dual-shaft shredder 1 is shown in FIG. 2 in the removed state of the housing 14.

The first and second cutting disc blocks 10, 12 are clamped against the flange 20. A bearing housing 24 is provided at the distal end from the gearbox 8 and is described in more detail below. The bearing housing 24 can be removed from the cutting disc blocks 10, 12 as a unit.

Figure 3:
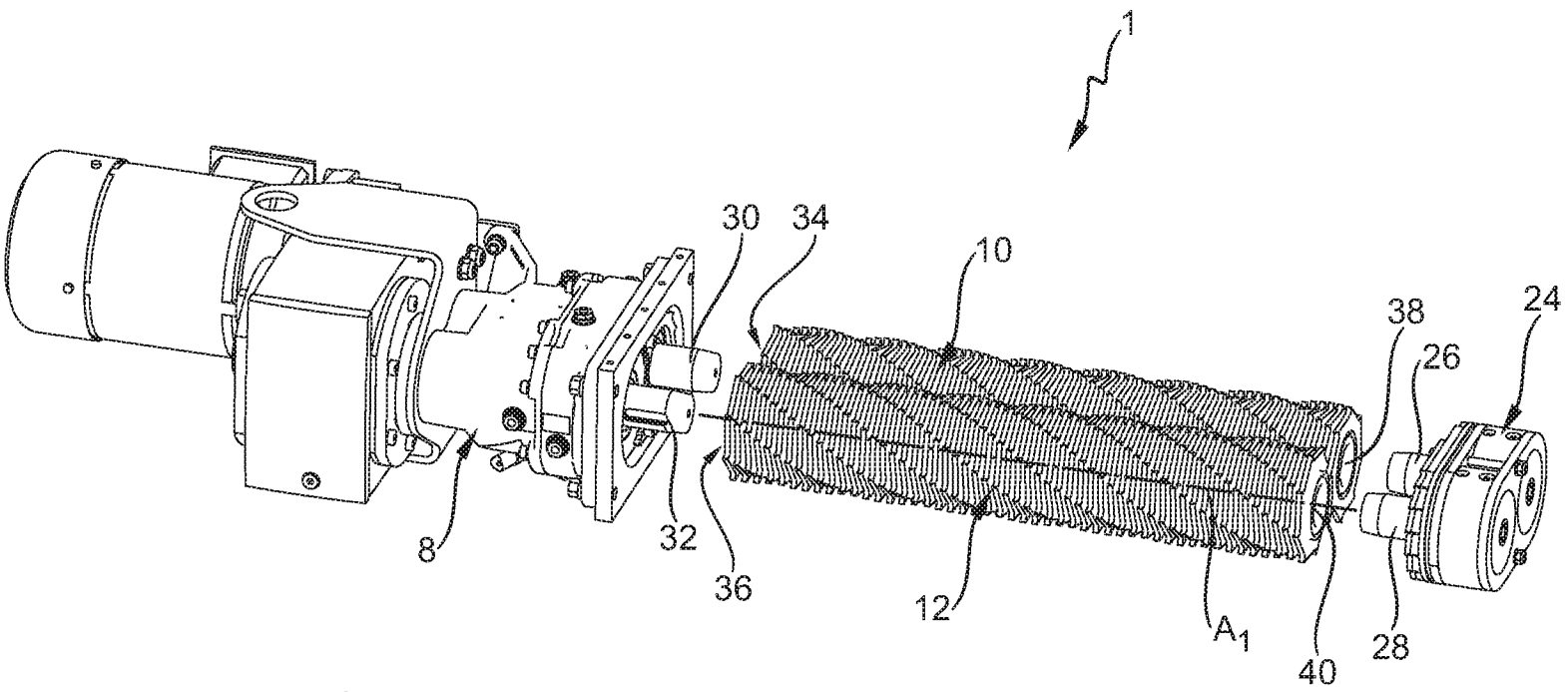
FIG. 3 is a third view of the dual-shaft shredder from FIGS. 1 and 2, having the cutting disc blocks removed and bearing housing removed.

FIG. 3 shows the removed state of the bearing housing 24. Two axle stubs 26, 28 protrude out of the bearing housing 24. Corresponding shaft stubs 30, 32 having geometry corresponding to the axle stubs 26, 28 extend out of the gearbox 8. While the shaft stubs 30, 32 protrude into first axial recesses 34, 36 of the cutting disc blocks 10, 12, the axle stubs 26, 28 are received in second axial recesses 38, 40 of the cutting disc blocks 10, 12. The first axial recesses 34, 36 and the second axial recesses 38, 40 are implemented symmetrical to each other, that is, particularly identical or largely identical in internal geometry. Complete mirror symmetry is not required, but rather the recesses 34, 36, 38, 40 are implemented such that the orientation of the cutting disc blocks 10, 12 can be rotated 180° relative to the longitudinal axis A1 thereof (as shown in FIG. 3).

Figure 4:
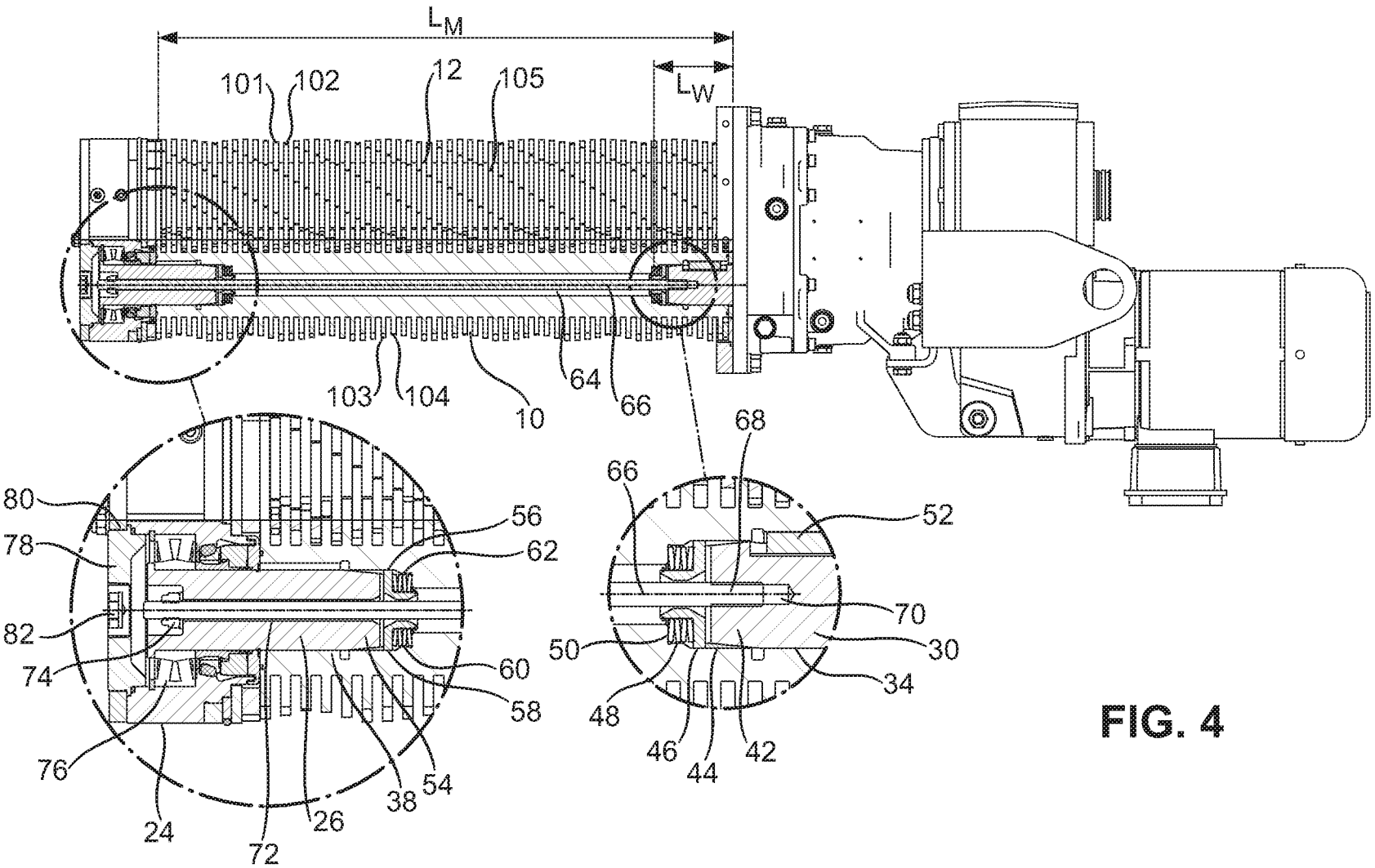
FIG. 4 is a partial section through the dual-shaft shredder from FIG. 2 with separate details showing a shaft stub and an axle stub.

With reference to FIG. 4 and particularly to the two details shown, the attachment of the cutting disc blocks 10, 12 in the dual-shaft shredder 1 is now described. FIG. 4 shows only the first cutting disc block 10 in section, while the second cutting disc block 12 is shown in plan view. It should be understood, however, that the second cutting disc block 12 is identical in section to the first cutting disc block 10. Altogether, the cutting disc blocks 10, 12 are implemented identical to each other, which also applies to the first and second shaft stubs 30, 32 and the first and second axle stubs 26, 28.

It can initially be seen in FIG. 4 that the shaft stub 30 extends for a length LW in the axial direction and the two cutting disc blocks 10, 12 extend over a length LM. The axial length LW is about 10% of the axial length LM. It is thus evident from FIG. 4 that the dual-shaft shredder 1 according to the present invention can be operated having different lengths of cutting disc blocks 10, 12. Only one axially adapted housing 14 is thus provided, in which the corresponding cutting disc blocks 10, 12 are received. The shaft stubs 30, 32 and the drive 6 and the gearbox 8 are not thereby changed.

The shaft stub 30 comprises a truncated cone-shaped segment 42 at the free end thereof. A sleeve 44 is provided in the interior of the recess 34 and correspondingly comprises a truncated cone-shaped segment at the inner diameter. Said segment corresponds to the truncated cone-shaped segment 42. The sleeve 44 contacts a transmitting element 46 in turn contacting a spring packet 48, comprising a plurality of spring washers in the present embodiment example. The spring washers of the spring packet 48 are then supported on a ring shoulder 50 in the cutting disc block 10. Depending on the embodiment, the spring packet 48 can also comprise only one single spring, particularly a spring washer.

A key 52 is provided for transmitting torque from the shaft stub 30 to the cutting disc block 10. As an alternative, a spline shaft connection or transmitting torque by frictional fit in the conical connection are also conceivable and preferable.

A second axial recess 38 is made in the opposite side of the cutting disc block 10. An axle insert in the form of an axle stub 26 is received in said axial recess 38. The external geometry of the axle stub 26 is altogether identical to that of the shaft stub 30 and also has a truncated cone-shaped segment 54. A sleeve 56 having a truncated cone-shaped inner segment, a transmitting element 58, and a spring packet 60 are provided correspondingly in the recess 38. The spring packet 60 is supported against a second ring shoulder 62.

The first and second axial recesses 34, 38 are connected to each other by means of a through hole 64. A threaded rod 66 extends through the through hole 64. A first end 68 of the threaded rod 66 is received in a corresponding threaded bore 70 of the shaft stub 30. From there, the threaded rod 66 extends through a through hole 72 in the axle insert implemented as an axle stub 26 and is coupled to a nut 74 at the outer end. By tightening the nut 74, the axle stub 26 can be clamped against the shaft stub 30 by means of the threaded rod 66. The conical segments 54, 56 and 42, 44 thereby ensure self-centering of the axle stub 26 and the shaft stub 30 in the recesses 38, 34. Additional pretensioning of the sleeves 56, 44 is provided by means of the spring packets 48, 60 via the transmitting element 46, 58, so that tensioning without clearance is achieved.

The outer end of the axle stub 26 is further received in a rolling bearing 76 supported correspondingly in the bearing housing 24. Access to the nut 74 is closed off by means of a cover 78 comprising a bayonet joint 80 having an internal hex drive 82, so that a user can remove the cover 78. After the cover 78 is removed, the nut 74 can be tightened or loosened. If the nut 74 is loosened, the clamping of the axle stub 26 against the shaft stub 30 is relieved, and when the nut 74 is removed, it is possible to remove the entire bearing housing 24 including the two axle stubs 26, 28, as shown in FIG. 3.

Because the clamping is relieved in this state, the two cutting disc blocks 10, 12 can be removed (see FIG. 3) and replaced with a second pair of cutting disc blocks 10, 12, or only the orientation thereof is modified. It has been demonstrated that, particularly in vertically oriented dual-shaft shredders 1, wherein the axis A1 (FIG. 3) is aligned vertically, wear on the cutting discs near the ground is greater, as heavy and hard objects tend to fall downward. By changing the orientation of the cutting disc blocks, the potentially worn lower ends can be placed in the upper region having lesser loading.

As can further be seen particularly in FIG. 4, the individual cutting discs are integrally connected to the inner hub body. Each cutting disc block 10, 12 is altogether made from a solid material by means of machining, particularly using turning and milling. Stress peaks are thereby prevented and service life is further increased.

Each cutting disc block 10, 12 comprises a plurality of individual cutting discs 101, 102, 103, 104 (only two of the cutting discs in the block 10, 12 have reference numerals). The number of cutting discs 101, 102, 103, 104 depends on the overall size of the dual-shaft shredder 1 and the comminuting task to be performed.

A plurality, particularly six, cutting edge elements 105 (see FIGS. 1 and 4) are further implemented at the circumference of each cutting disc 101, 102, 103, 104 and evenly distributed in the circumferential direction. The cutting edge elements form helical curves 106 of a six-start thread (a higher or lower number of thread starts is also possible) having a steep pitch along the circumference of each cutting disc block 10, 12. The cutting edge elements 105 of the cutting disc block 10 here form a left-handed thread (whereby a right-handed thread is also possible and preferable), and the cutting edge elements 105 of the cutting disc block 12 do the same. The two cutting disc blocks 10, 12 are thereby implemented identically.

Figure 5:
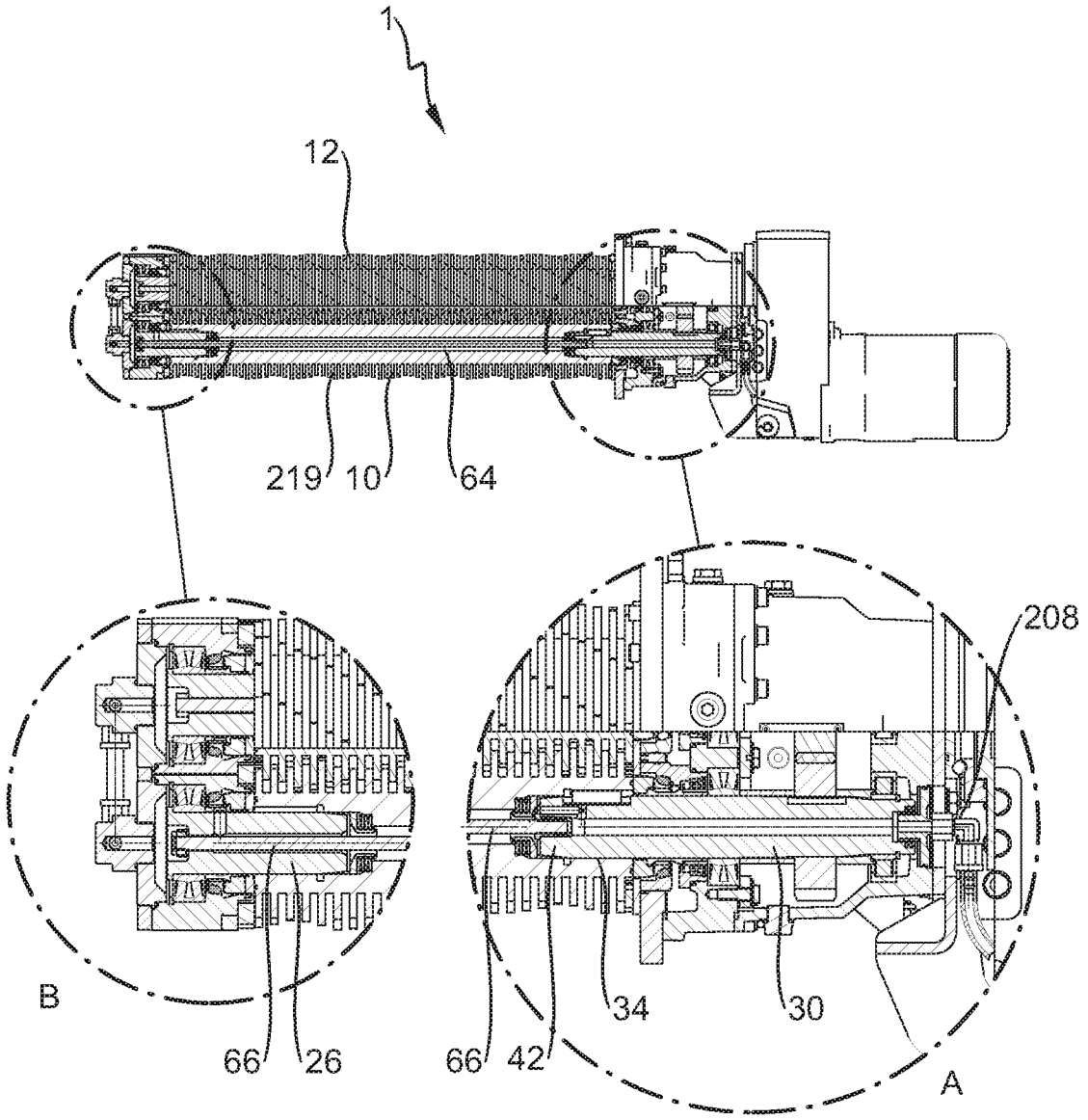
FIG. 5 is an overview showing a partial section view of a dual-shaft shredder of a second embodiment example having two separate details.
Figure 6A:
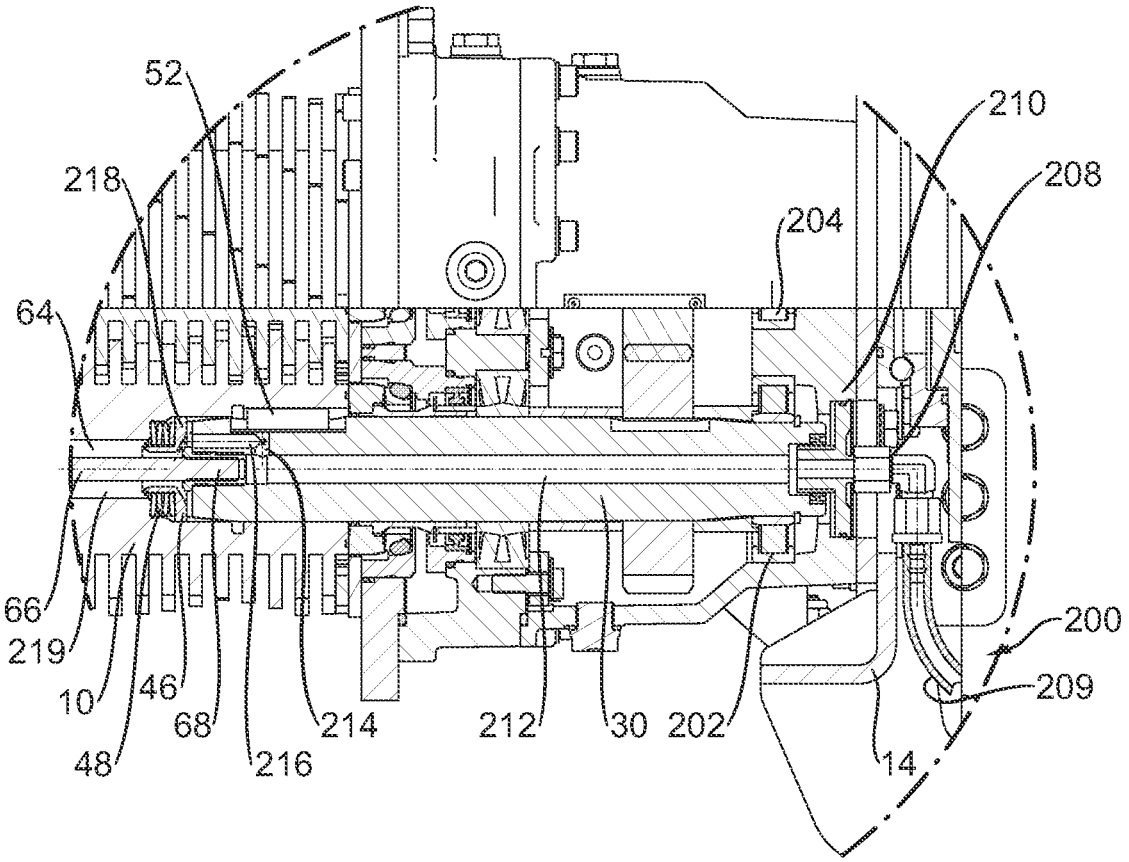
FIG. 6A is an enlarged view of detail A from FIG. 5.
Figure 6B:
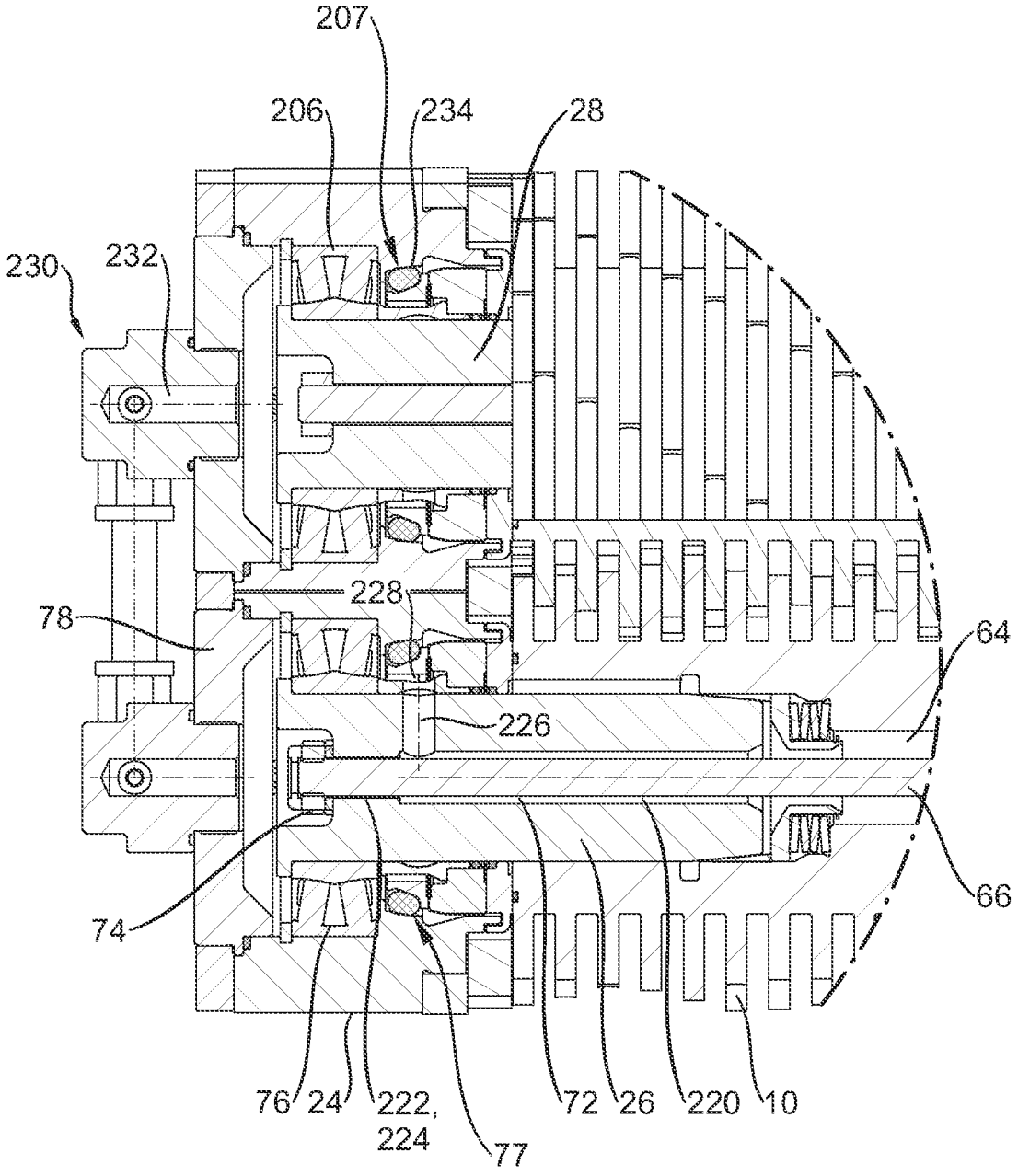
FIG. 6B is an enlarged view of detail B from FIG. 5.

FIGS. 5, 6A, and 6B illustrate a second embodiment example of a dual-shaft shredder 1. Identical and similar elements have the same reference numeral as the first embodiment example (FIGS. 1 through 4), so that reference is made thereto in full. The differences from the first embodiment example are particularly emphasized below.

In addition to the first embodiment example (FIGS. 1 through 4), the dual-shaft shredder 1 of the second embodiment example (FIGS. 5, 6A, 6B) comprises an oil supply device 200 for lubricating the first and second cutting disc blocks 10, 12 As seen in FIGS. 5 and 6A, the first and second cutting disc blocks 10, 12 are supported on the housing 14 by means of the first and second shaft stubs 30, 32. To this end, the first shaft stub 30 is supported in a first bearing, implemented here as a rolling bearing, more specifically as a first spherical rolling bearing 202, and the second shaft stub 32 is supported in second bearing, implemented here as a rolling bearing, more specifically as a second spherical rolling bearing 204, of which only part is visible in FIG. 6A but implemented correspondingly to the first spherical rolling bearing 202.

The first axle insert 26 is supported in the rolling bearing 76 supported at the bearing housing 24 at the axially opposite side of the cutting disc blocks 10, 12 (see FIG. 6B). The rolling bearing 76 is implemented as a first taper rolling bearing for better receiving axial forces. The second axle insert 28 is supported in a corresponding rolling bearing 206 implemented as a second taper rolling bearing and also supported on the bearing housing 24.

In order to supply oil to said bearings 76, 206, an oil connection 208 is provided at the housing 14. In the present embodiment example, the oil connection 208 is connected to a hose 209 by means of which oil can be provided at the oil connection 208, preferably at a predefined oil pressure. In addition to the bearings 76, 206, corresponding face seals 77, 207 associated therewith are also preferably supplied with oil. There can also be embodiments in which only the face seals 77, 207 are supplied with oil.

The oil connection 208 opens within the housing 14 into a sealed oil coupling 210, in turn fluidically connected to a first axial channel 212 running through the first shaft stub 30. Said first axial channel 212 is connected to a first radial channel 214, in turn fluidically connected to a second axial channel 216. The first radial channel 214 is substantially closed off radially externally by means of the key 52. It can occur that a small amount of oil escapes, and then collects in the region of the key or under the same, but this does not further inhibit operation. Production is thereby facilitated. The first radial channel 214 can be bored radially in the first shaft stub 30 in the region of the groove for the key 52 and an additional closure is not required.

The second axial channel 216 then exits from the first shaft stub 30 at the end face (with reference to FIG. 6A, left). A diagonal channel 218 is cut in the transmitting element 46 receiving the spring packet 48 and opens into the first axial bore 64 in the first cutting disc block 10. In this manner, the first axial bore 64 is connected to the oil connection 208. The first axial channel 212, the first radial channel 214, the second axial channel 216, the diagonal channel 218, and the bore 64 together form segments of a first oil channel 219 running through the bore 64.

As a result, oil flows from the oil connection 208 into the first axial bore 64 of the first cutting disc block 10. Because the inner diameter of the bore 64 is selected to be correspondingly greater than the outer diameter of the threaded rod 66, the flow is also not impeded.

The through hole 72 is implemented in the first axle insert 26 at the opposite end of the first cutting disc block 10 (FIG. 6B), deviating from the first embodiment example (FIG. 4): in a first segment 220, the through hole 72 has an enlarged inner diameter, particularly greater than the outer diameter of the first threaded rod 66. The corresponding thread 224 is made only in a second segment 222, distal with respect to the first cutting disc block, and engages with the first threaded rod 66. A second radial channel 226 is made in the first axle insert 26 and opens radially into a first bearing space 228 and can thus supply the bearing 76 and preferably the face seal 77 with oil. The through hole 72 and the second radial channel 226 also form a segment of the first oil channel 219.

Instead of a simple cover 78, as in the first embodiment example (FIGS. 1 through 4), in the present embodiment example (FIGS. 5, 6A, 6B), a connecting unit 230 having a second oil channel 232 is provided. Said second oil channel 232 connects the first bearing space 228 with a second bearing space 234 associated with the second cutting disc block 12, more precisely the rolling bearing 206. In this manner, the second oil channel 232 provides oil for the second cutting disc block 12.

Leak-tightness can be tested in that a predefined pressure is applied at the oil connection 208 and said pressure or the oil level is monitored. If a change in the oil level or the pressure is detected, then there is a leak to be closed off in the oil supply device 200, that is, in a seal sealing the oil circuit against the surrounding area or against the interior space of the dual-shaft shredder.

Said oil supply device 200 is then particularly advantageous if the end of the dual-shaft shredder 1 in which the axle inserts 26, 28 are provided is installed in a drain or the like, so that the bearings 76, 206 are not easily accessible for lubricating. The present consideration makes particular use of the bore 64 and uses the same as a segment of the first oil channel 219. A particularly advantageous design is thereby achieved.

The invention claimed is:

1. A dual-shaft shredder for comminuting solids or solids in liquids comprising:

a housing defining an interior comminuting space;

an inlet opening in the housing for feeding solids into the comminuting space;

an outlet opening in the housing for discharging comminuted solids out of the comminuting space;

a first cutting disc block having a plurality of first cutting discs disposed on a first hub body such that an intermediate space is present between each two adjacent first cutting discs and a second cutting disc block having a plurality of second cutting discs disposed on a second hub body such that an intermediate space is present between each two adjacent second cutting discs, the first and second cutting disc blocks being axially offset from each other, such that at least some of the first cutting discs each engage in the intermediate space between two adjacent second cutting discs and at least some of the second cutting discs each engage in an intermediate space between two adjacent first cutting discs, the first and second cutting disc blocks each comprising a first axial recess;

a first shaft stub extending into the first axial recess of the first cutting disc block for transmitting torques;

a second shaft stub extending into the first axial recess of the second cutting disc block for transmitting torques;

a first clamping device clamping the first shaft stub against the first cutting disc block under tension; and a second clamping device clamping the second shaft stub against the second cutting disc block under tension;

further comprising a first and a second axle insert, wherein the first and second cutting disc blocks each comprise a second axial recess, respectively, and the first axle insert is received in the second axial recess of the first cutting disc block and the second axle insert is received in the second axial recess of the second cutting disc block;

wherein the first and second axial recesses of each of the first and second cutting disc blocks, respectively, are each connected to each other by an axial bore having a smaller diameter than the respective first and second axial recesses so as to form first and second shoulders for each of the first and second cutting disc blocks, and wherein the first and second clamping devices clamp the first axle insert against the first shaft stub and the second axle insert against the second shaft stub, respectively.

2. The dual-shaft shredder according to claim 1, wherein the first cutting disc block is fixedly attached to the first shaft stub and the second cutting disc block is fixedly attached to the second shaft stub.

3. The dual-shaft shredder according to claim 2, wherein the first cutting disc block and the second cutting disc block are each fixedly attached to the first and second shaft stub, respectively, by a positive shaft-hub connection.

4. The dual-shaft shredder according to claim 1, wherein the first and second shaft stub each comprise a truncated cone-shaped segment contacting a corresponding truncated cone-shaped segment of the first axial recesses of the first and second cutting disc blocks, respectively.

5. The dual-shaft shredder according to claim 4, wherein the truncated cone-shaped segment of the cutting disc blocks is formed by a sleeve placed in the first axial recesses.

6. The dual-shaft shredder according to claim 5, wherein the sleeve is pre-tensioned by means of a spring packet.

7. The dual-shaft shredder according to claim 1, wherein the first and second clamping devices comprise a first and second threaded rod, respectively.

8. The dual-shaft shredder according to claim 7, wherein the first threaded rod is received in a threaded hole in the first shaft stub and extends into or through a through hole in the first axle insert, and wherein the second threaded rod is received in a threaded hole in the second shaft stub and extends into or through a through hole in the second axle insert.

9. The dual-shaft shredder according to claim 1, wherein the first and second axle inserts each comprises an axle stub for supporting the first and second cutting disc blocks, respectively.

10. The dual-shaft shredder according to claim 1, wherein the first and second axle inserts each comprises a truncated cone-shaped segment contacting a corresponding truncated cone-shaped segment of the second axial recesses of the first and second cutting disc blocks.

11. The dual-shaft shredder according to claim 1, wherein the first and second axial recesses in the first and second cutting disc blocks are implemented symmetrical to each other.

12. The dual-shaft shredder according to claim 1, wherein a first and second axle stub for supporting the first and second cutting disc blocks, respectively, are received in a bearing housing forming a unit together with the first and second axle stubs, said unit being reversibly removable from the cutting disc blocks and/or the housing.

13. A dual-shaft shredder for comminuting solids or solids in liquids comprising:

a housing defining an interior comminuting space;

an inlet opening in the housing for feeding solids into the comminuting space;

an outlet opening in the housing for discharging comminuted solids out of the comminuting space;

a first cutting disc block having a plurality of first cutting discs disposed on a first hub body such that an intermediate space is present between each two adjacent first cutting discs and a second cutting disc block having a plurality of second cutting discs disposed on a second hub body such that an intermediate space is present between each two adjacent second cutting discs, the first and second cutting disc blocks being axially offset from each other, such that at least some of the first cutting discs each engage in the intermediate space between two adjacent second cutting discs and at least some of the second cutting discs each engage in an intermediate space between two adjacent first cutting discs, the first and second cutting disc blocks each comprising a first axial recess;

a first shaft stub extending into the first axial recess of the first cutting disc block for transmitting torques;

a second shaft stub extends into the first axial recess of the second cutting disc block for transmitting torques;

a first clamping device clamping the first shaft stub against the first cutting disc block under tension;

a second clamping device clamping the second shaft stub against the second cutting disc block under tension; and an oil supply device supplying a bearing of the first or second cutting disc block associated with said bearing with oil through an oil channel extending through the first or second cutting disc block;

further comprising a first and a second axle insert, wherein the first and second cutting disc blocks each comprise a second axial recess, respectively, and the first axle insert is received in the second axial recess of the first cutting disc block and the second axle insert is received in the second axial recess of the second cutting disc block;

wherein the first and second axial recesses of each of the first and second cutting disc blocks, respectively, are each connected to each other by an axial bore having a smaller diameter than the respective first and second axial recesses so as to form first and second shoulders for each of the first and second cutting disc blocks, and wherein the first and second clamping devices clamp the first axle insert against the first shaft stub and the second axle insert against the second shaft stub, respectively.

14. The dual-shaft shredder according to claim 13, further comprising ring seals disposed about the first or second cutting disc block associated with said bearing.

15. The dual-shaft shredder according to claim 13, wherein the oil channel comprises a first oil channel segment running through the first axial bore of the first cutting disc block.

16. The dual-shaft shredder according to claim 15, wherein the oil supply device further comprises a second oil channel segment fluidically connected to the first oil channel segment and providing oil for a bearing of the second cutting disc block.

17. The dual-shaft shredder according to claim 15, wherein the first oil channel segment runs through the first shaft stub or the first axle insert.

18. A dual-shaft shredder for comminuting solids or solids in liquids comprising:

a housing defining an interior comminuting space;

an inlet opening in the housing for feeding solids into the comminuting space;

an outlet opening in the housing for discharging comminuted solids out of the comminuting space;

a first cutting disc block having a plurality of first cutting discs disposed on a first hub body such that an intermediate space is present between each two adjacent first cutting discs and a second cutting disc block having a plurality of second cutting discs disposed on a second hub body such that an intermediate space is present between each two adjacent second cutting discs, the first and second cutting disc blocks being axially offset from each other, such that at least some of the first cutting discs each engage in the intermediate space between two adjacent second cutting discs and at least some of the second cutting discs each engage in an intermediate space between two adjacent first cutting discs, the first and second cutting disc blocks each comprising a first axial recess;

a first shaft stub extending into the first axial recess of the first cutting disc block for transmitting torques;

a second shaft stub extends into the first axial recess of the second cutting disc block for transmitting torques;

a first clamping device clamping the first shaft stub against the first cutting disc block under tension;

a second clamping device clamping the second shaft stub against the second cutting disc block under tension;

an oil supply device supplying a bearing of the first or second cutting disc block associated with said bearing with oil through an oil channel extending through the first or second cutting disc block; and an oil monitoring device detecting a leakage of a seal sealing the bearing, wherein the oil monitoring device monitors an oil level or an oil pressure in the oil channel;

wherein the oil channel comprises a first oil channel segment running through the first axial bore of the first cutting disc block; and the first oil channel segment runs through the first shaft stub or the first axle insert.

19. A dual-shaft shredder for comminuting solids or solids in liquids comprising:

a housing defining an interior comminuting space;

an inlet opening in the housing for feeding solids into the comminuting space;

an outlet opening in the housing for discharging comminuted solids out of the comminuting space;

a first cutting disc block having a plurality of first cutting discs disposed on a first hub body such that an intermediate space is present between each two adjacent first cutting discs and a second cutting disc block having a plurality of second cutting discs disposed on a second hub body such that an intermediate space is present between each two adjacent second cutting discs, the first and second cutting disc blocks being axially offset from each other, such that at least some of the first cutting discs each engage in the intermediate space between two adjacent second cutting discs and at least some of the second cutting discs each engage in an intermediate space between two adjacent first cutting discs, the first and second cutting disc blocks each comprising a first axial recess;

a first shaft stub extending into the first axial recess of the first cutting disc block for transmitting torques;

a second shaft stub extending into the first axial recess of the second cutting disc block for transmitting torques;

a first clamping device clamping the first shaft stub against the first cutting disc block under tension; and a second clamping device clamping the second shaft stub against the second cutting disc block under tension;

wherein the first and second shaft stub each comprise a truncated cone-shaped segment contacting a corresponding truncated cone-shaped segment of the first axial recesses of the first and second cutting disc blocks, respectively.

* * * * *